73-151 SR
11/4/80 OR 4,231,252

United States Patent [19] [11] 4,231,252
Cherkson [45] Nov. 4, 1980

[54] BOREHOLE DIRECTION MEASUREMENT MEANS

[75] Inventor: Leonard A. Cherkson, Mt. Isa, Australia

[73] Assignee: Mount Isa Mines Limited, Brisbane, Australia

[21] Appl. No.: 961,898

[22] Filed: Nov. 20, 1978

[30] Foreign Application Priority Data

Nov. 24, 1977 [AU] Australia ..... 2534

[51] Int. Cl.[3] ..... E21B 47/024
[52] U.S. Cl. ..... 73/151; 33/313
[58] Field of Search ..... 73/151; 33/312, 313; 364/422

[56] References Cited

U.S. PATENT DOCUMENTS

| | | | |
|---|---|---|---|
| 3,545,266 | 12/1970 | Wilson | 73/151 |
| 3,587,176 | 6/1971 | Schnerb | 33/313 X |
| 3,691,363 | 9/1972 | Armistead | 364/422 X |
| 4,021,774 | 5/1977 | Asmundsson et al. | 33/313 X |

*Primary Examiner*—Jerry W. Myracle
*Attorney, Agent, or Firm*—Beveridge, DeGrandi, Kline & Lunsford

[57] ABSTRACT

This invention relates to a device for providing data for determining a non-horizontal change from one direction to another of a reference axis fixedly associated with a body.

The apparatus uses gravity sensor devices, such as accelerometers, to provide data for determining change in both azimuth and slant angle. In some embodiments that data may be derived from the signal of a single accelerometer.

Some embodiments of the invention are probes for surveying in geological boreholes. In some of such embodiments a single gravity sensor is fixed to a mass which is mounted for free rotation.

Drive elements are provided whereby the mass may be rotated and then allowed to rotate undriven.

Thus the direction in which the sensor is responsive to the gravity vector is, due to inertia of the mass, independent from random axial rotation of the probe. A time reference is used to measure axial rotation with respect to a vertical plane of the sensor from a sensor signal providing data from which both azimuth angle and slant angle changes may be calculated.

In other embodiments, gravity sensors are fixedly mounted within a probe and the probe is restrained by tracking elements from random axial rotation. Statistical methods may thus be applied to sensor signal data to correct for dislocations in an azimuth curve such as occur at borehole liner interconnection points.

18 Claims, 19 Drawing Figures

BOREHOLE DIRECTION MEASUREMENT MEANS

BACKGROUND OF THE INVENTION

There are several situations in which it is useful to know the direction in which a body is moving in three dimensional space other than in a horizontal direction.

One example is in plotting the co-ordinates of a borehole or well.

When boreholes for geological testing and exploration or the like are drilled the hole rarely if ever extends in a straight line from the surface. The drill bit wanders from the straight line path in a relatively gradual but erratic manner and accordingly it is necessary for accurate charting of sub-surface formations and the like to determine the spatial co-ordinates of the boreholes from point to point so that its shape and position may likewise be determined.

Plotting of the coordinates may be achieved by lowering into the borehole a body in the form of a probe which transmits data as to the probe's direction, which is coincident with the borehole axis direction, from positions as the probe advances along the borehole axis and measuring the distance the probe travels between those positions.

A second example would be in plotting the trajectory for example of a rocket when the rocket has a trajectory which is in a horizontal direction for a very short period during the total trajectory.

The present invention is described herein with reference to its application in plotting the coordinates of boreholes but it will be understood that this is merely one application of the invention described and is not limiting.

Boreholes of the type under discussion rarely extend in a horizontal plane and a "borehole" is herein defined as a hole which has no substantial portion extending horizontally.

Normally the measurement of borehole co-ordinates is performed utilizing the polar co-ordinate system with parameters of hole length, slant and azimuth angles. The slant and azimuth angles are functions of the independent variable, namely borehole length, and their values are measured at predetermined points spaced from a borehole origin, which may be the top or bottom of the borehole.

To this end probes have been developed which may be lowered into and withdrawn from the borehole with sensors determining the slant and azimuth angle. It is of course necessary to measure those angles against known reference directions.

For slant angle (or inclination) measurement it is customary to use either the inertial reference of a gyroscope axis or to use the direction of the earth's gravitational field as a reference.

In the case of an inertial reference using using a gyroscope, the slant angle sensing means suffers from the disadvantage of being relatively expensive and delicate and easily damaged by shock. Suitable gyroscope have a limited useful life due to wear. Moreover errors in derived measurements are introduced due to precession and the earths drift rate.

In the case of a gravity reference, the gravity sensing device may be an accelerometer. The use of accelerometers for this purpose has many advantages, including high sensitivity and accuracy, small size, relative robustness and mechanical simplicity. For azimuth angle measurement it is again customary to use the inertial reference of a gyroscope axis, although the same disadvantages apply to this application as apply to their use for slant angle measurement.

The earth's magnetic field has also been used as a reference direction in relation to which to measure azimuth angle at points along a borehole, using for example magnetic gates as sensors, but in that case the instrumentation involved suffers from the disadvantage that error is introduced by localized variations in the earth's magnetic field due for, for example, to the common occurence of iron ores in the borehole vicinity.

Probes carrying gyroscopes and or magnetic field sensing instruments are necessarily of a diameter which is inconveniently large requiring a certain minimum diameter of the probe which prevents it from being used in smaller diameter boreholes which for exploratory purposes at least would be quite satisfactory.

As is well known slant angle may be measured by gravity sensors such as accelerometers in several ways.

For example one accelerometer may be fixed so as to measure the component of the earth's gravitational field in the direction of the probe axis. In this case a signal output from the accelerometer is invariant with rotation of the probe about the borehole axis.

Slant angle may also be measured by two accelerometers set at right angles to each other and to the probe axis.

Generally however it is convenient to use three accelerometers, each set at right angles to the other since in this case the sum of the vectors measured is a constant resulting in simplified calculations, easier error detection, and greater sensitivity over the possible range of slant directions.

Accelerometers have not, however, previously been used to measure azimuth angle.

For an accelerometer fixed to a probe, difficulty in measuring azimuth angle would be introduced by uncontrolled rotation of the probe about the borehole axis.

In that event change in the gravity vector as measured by an accelerometer would need to be resolved into components due to change in azimuth angle, and due to change in inclination, and due to axial rotation. Such resolution is not possible against the single reference direction of the earth's gravitational field.

SUMMARY OF THE INVENTION

With the foregoing in mind an object of the present invention is the provision of means for determining direction using only the earth's gravitational field and time as references.

A further object is the provision of a probe for obtaining data for determining coordinates at positions in boreholes which probe uses only gravity sensor signals for determining azimuth and slant angle and which, at least in some embodiments, is of smaller diameter than previously known probes and does not suffer from many of the disadvantages discussed above of gyroscopes and magnetic sensors.

In at least one embodiment, the invention enables both azimuth angle and slant angle to be derived from the signal of one gravity sensor such as a single accelerometer.

The invention achieves those objects at least in some embodiments by mounting the gravity sensor to a mass mounted for free rotation about the probe axis so that the sensor direction, that is to say the direction in which the sensor measures the gravity vector, is, due to inertia, independent of uncontrolled rotation of the probe about the probe axis.

In those embodiments the invention introduces a time reference, by means of which a measure of axial rotation of the sensor may be obtained and a change in azimuth angle of the sensor direction can be determined.

According to a first aspect the invention consists in means for providing data for determining a change from one direction to another of a reference axis fixedly associated with a body, when at least one of said directions is non horizontal, comprising:

first gravity sensor means defining a first sensor direction which is at a constant sensor angle with respect to said reference axis, for producing a first signal or signals responsive to the component of the earth's gravity vector in said first sensor direction, rotation determining means for measuring change, if any, of the reference angle, as herein defined, of said first sensor direction, and means for determining the change, if any, in inclination of said first sensor direction.

According to a second aspect the invention consists in means according to the first aspect comprising:

a mass fixedly associated with said body and mounted for undriven rotation about said reference axis, said first sensor means being, or being fixedly associated with, said mass; the inertia of said mass being such that said sensor direction at any instant is substantially independent of rotation of said body about said reference axis, drive means whereby said mass may be driven to a predetermined angular velocity about said reference axis and then allowed to rotate undriven, and means for comparing selected parameters of said first signal or signals as occuring during one time period with said selected parameters as occuring during another time period.

According to a third aspect the invention consists in means according to the fist aspect when said body is a probe for surveying a borehole as herein defined, and said reference axis is in a direction coincident with or parallel to the direction of advance of said probe along the axis of a borehole to be surveyed, and said first gravity sensor means is an accelerometer, wherein said rotation determing means comprise, restraining means whereby at least said first gravity sensor is substantially restrained from random rotation about said axis of said borehole, computor means for correcting for abrupt discontinuities in said first signal, and wherein said means for determining change in inclincation are second gravity sensor means producing a second signal responsive to the component of the earth's gravity vector in a second sensor direction at a fixed angle to said first sensor direction, whereby changes in inclination and abrupt changes in said reference angle may be measured from said first and said second signals.

BRIEF DESCRIPTION OF THE DRAWINGS

The invention will now be described and explained with reference to the accompanying drawings in which.

DESCRIPTION

Figure 1D:
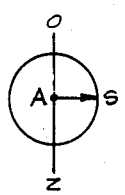
FIGS. 1*a* to 1*d* are diagramatic representations to which reference is made in the explanation which follows.
Figure 1C:
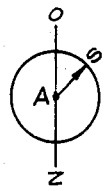
Figure 1B:
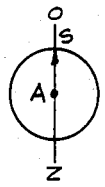
Figure 1A:
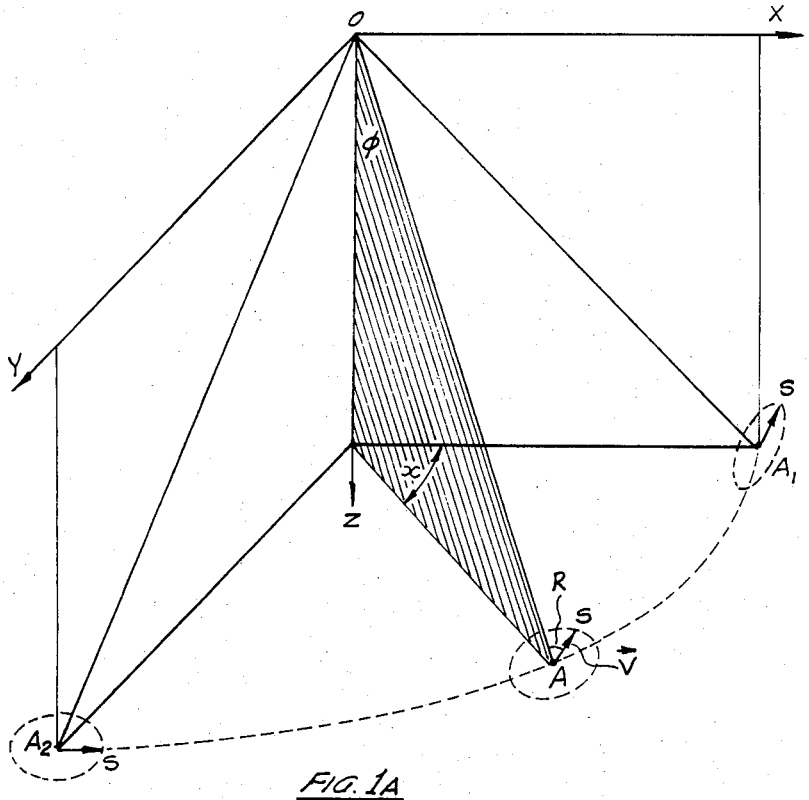

With reference to FIG. 1*a*, OA is a direction having an azimuth angle $\alpha$ and a slant angle $\phi$ relative a set of co-ordinates OX, OY, OZ.

OZ is vertical i.e. in the direction of the earth's gravity vector and it is convenient to assume OX to be the north-south direction.

AS indicates the direction in which a gravity sensor at A measures a component $\vec{V}$ of the gravity vector.

AS is at an angle R to direction OA. Angle R may be any angle, that is to say direction AS is not coincident with OA. It will be hereinafter assumed that AS is perpendicular to OA.

Assume the gravity sensor is free to rotate about the axis OA. The vector $\vec{V}$ will then rotate about that axis and it is useful to define a reference angle for vector $\vec{V}$ about axis OA.

As herein defined "the reference angle" at any instant of a vector $\vec{V}$ originating on and rotating about a non-vertical axis OA means the angle between (1) the plane in which both the vector $\vec{V}$ and axis OA lie and (2) that part which is below the axis OA, of the vertical plane in which the axis OA lies, or of a reference plane at a constant angle to that vertical plane.

It should be noted that that vertical plane includes the lowest point of the locus of the end of the vector $\vec{V}$ remote from said axis.

It should also be noted that the definition of "reference angle" excludes the case in which OA is vertical since in that special case the locus of the vector tip is horizontal and a reference angle as defined would be indeterminate.

For a line $OA_1$ of given slant angle $\phi$, if sensor direction AS is initially in the XOZ plane and sensor direction AS remains parallel to the XOZ plane while line OA moves from $OA_1$ to a new direction $OA_2$ the reference angle as defined of vector $\vec{V}$, will alter by an angle equal to the change in azimuth angle of line OA.

One way in which AS could be kept parallel to the XOZ plane would be to fixedly associate the sensor with a mass mounted for inertial rotation about $OA_1$. Then when OA moves from $OA_1$ to $OA_2$, AS would remain parallel to the XOZ plane during change in direction of line OA from $OA_1$ to $OA_2$. This is illustrated in FIGS. 1*b*, 1*c* & 1*d* showing sections perpendicular to OA when at $OA_1$, OA and $OA_2$ respectively.

In a simple from the invention utilizes the facts that if line OA lies in a known direction for example OA1 in the XOZ plane and at an inclination $\phi$, and if AS is that direction in which a gravity sensor such as an accelerometer measures the gravity component and produces for example a signal voltage depending upon the gravity component measurement, and AS is rotated at a constant angular velocity about OA, then (1) The signal output will vary cyclically as a function of time.

(2) The instant at which AS is in the direction of the vertical plane in which axis $OA_1$ lies can be determined from the instant in said cyclical signal when the signal passes through its maximum value.

(3) The constant angular velocity can be determined from the time required for a complete cycle.

(4) The reference angle can be calculated at any instant from the time interval between the signal maximum and the instant at which the angle is to be determined.

It will be appreciated that the reference angle can equally well be calculated with reference to other signal parameters, for example, the signal minimum or signal slope, zero cross-over point etc.

Thus, in one embodiment of the invention, a sensor such as an accelerometer is fixedly associated with a mass mounted for inertial rotation about an axis $OA_I$ and when $OA_1$ moves to a new direction $OA_2$, there is a shift relative to a time reference in the cyclical signal as the result of change in the reference angle, which changes by an amount equal to the change in azimuth angle of OA.

If the sensor direction is for example rotating about OA at 45° per second then the signal at $OA_1$ will indicate a maximum once every 8 seconds. If the direction of OA changes, in a short time interval, to $OA_2$ representing an azimuth angle change of 90°, the reference angle changes by 90° and the next maximum may occur after 6 seconds (or 2 seconds, depending on the direction of rotation) instead of 8 seconds, i.e. there is a discrepancy between the phase of the signal at $OA_2$ and the signal at $OA_I$ relative to an external time scale.

If the angular velocity of the sensor is not known, or is not constant, it is necessary to have means to compare the signal for example during a period when OA is in a constant direction with the signal during a period when its direction is changing. A constant speed recorder would suffice.

In practice this advance or retardation can be determined either by measuring the reference time intervals between a selected signal parameter (for example signal maximums or zero cross over points) or by measuring the change in a selected signal parameter at constant time intervals or by comparing signal parameters as a function of a single reference time scale.

It is not essential that the angular velocity of AS remains a constant, and in fact in practice it is desirable to drive the sensor to a predetermined velocity and then to allow it to rotate undriven.

Provided measurements are made during undriven rotation and during constant time intervals at the commencement of which the sensor has a known angular velocity, the total number of revolutions during each constant interval will remain constant for each direction, and the signal parameter measured may be the change in total number of cycles and fractions thereof measured during constant time intervals.

Apparatus according to the invention can therefore be calibrated for example by measuring a change in reference angle while axis OA is in a constant direction during a constant reference time interval and the measuring the change in reference angle which occurs during an identical subsequent time interval during which change in direction of OA occurs.

In the case when the apparatus is mounted in a probe, it is possible to hold the probe at a stationary position in a borehole, during intervals when the sensor is driven to a constant velocity and then to move the probe to a new position during time intervals of predetermined duration while rotation of the sensor is undriven.

It should also be understood that the inclination or slant angle of the direction OA may also be determined from the sensor signal, for example from the maximum amplitude of the cyclical signal, and consequently a change in direction of the body can be determined from change in inclination and change of reference angle (and hence azimuth angle) as determined from a sensor signal.

In preferred embodiments of the invention three sensors at right angles to each other are used for convenience and for greater sensitivity.

According to a further embodiment, the invention is used for a probe for surveying boreholes and the probe case is restrained from random rotation about the probe axis, which corresponds to the borehole axis, by tracking means. In that event a gravity sensor may be fixedly mounted with respect to the probe case.

If the gravity sensor is fixed to the probe and thus substantially restrained from rotation during sliding advance of the probe in the borehole, the sensor signal will be substantially invariant due to rotation during the probes advance in the borehole liner and azimuth angle can be determined from change in the gravity sensor signal provided that inclination of the probe axis is also determined; for example, by a second gravity sensor responsive to the component of the gravity vector AS measured in the probes axial direction. Customarily, the borehole pipe liner is made up of lengths of straight pipe screw connected together. The means for restraining rotation according to the presently discussed embodiment consist of tracking means engaging the borehole liner. When the probe traverses the junction between one liner pipe and another (at which points the major angular deviations in the borehole occur) the screw threads it encounters are likely to cause an abrupt and substantial rotation of such embodiments of the probe having tracking means. In that event computing means may be adapted to compute the borehole coordinates progressively, utilizing a mathematical model to compute the azimuth curve and angles on the assumption that the real borehole azimuth angle function in relation to borehold length (hereinafter called the azimuth curve) has no discontinuities.

Figure 2A:
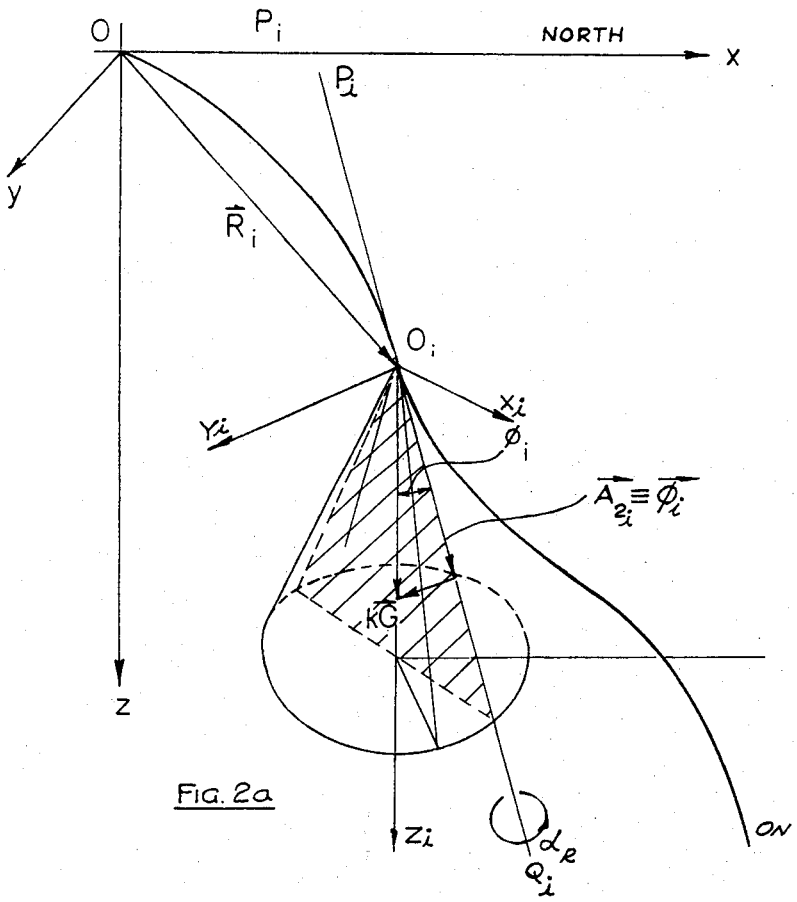
FIGS. 2*a* and 2*b* are diagramatic views of a coordinate measuring system employing embodiments of the invention.
Figure 2B:
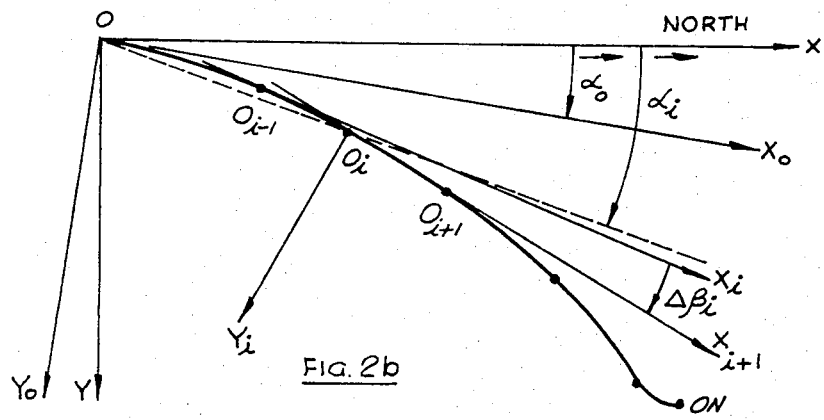

With reference to FIG. 2 there is shown a borehole coordinate reference system where the Z axis coincides with the gravity vector, the X axis is a perpendicular to Z axis (e.g. to coincide with the N-S direction) and the Y axis is a perpendicular to the X axis in the horizontal plane, with respect to which the borehole co-ordinates can be determined. The polar reference to any point $O_i$ of the borehole consists of the radius vector $\vec{R}_i$, or the calaculated borehole length from the origin, slant $\phi_i$ and azimuth $\alpha_i$ (or bearing angle increment $\Delta B_i$) angular co-ordinates. The angle $\phi_i$ at the known point $O_i$ will be completely identified by the tangents $P_iQ_i$, in the vertical planes $X_iO_iZ_i$, where the axis $O_iX_i$ is tangent to point $O_i$ of the borehole curve. The slant angle is determined by the $A_z$ vector and may be measured by a gravity sensor along the longitudinal axis or by two gravity sensors set at 90° to the longitudinal axis of a probe in a conventional manner.

The azimuth angle $\alpha_i$ will be determined relative to the X axis direction. The value of the azimuth angle at the point $O_i$ will include both a true azimuth angle $\alpha_i$ between the X axis of the reference system in the horizontal plane and an angle error $\Delta\alpha_i$ which is a result of the additional rotation of the gravity sensors around the borehole axis. Therefore, the measuring system has to compute or eliminate the error angles $\Delta\alpha_1, \Delta\alpha_2, \Delta\alpha_i, \ldots \Delta\alpha_N$ from the data of the azimuth angle measurement. This is achieved by the probe construction and in some embodiments by the mathematical computing of the continuous azimuth angle of azimuth angles.

Figure 3:
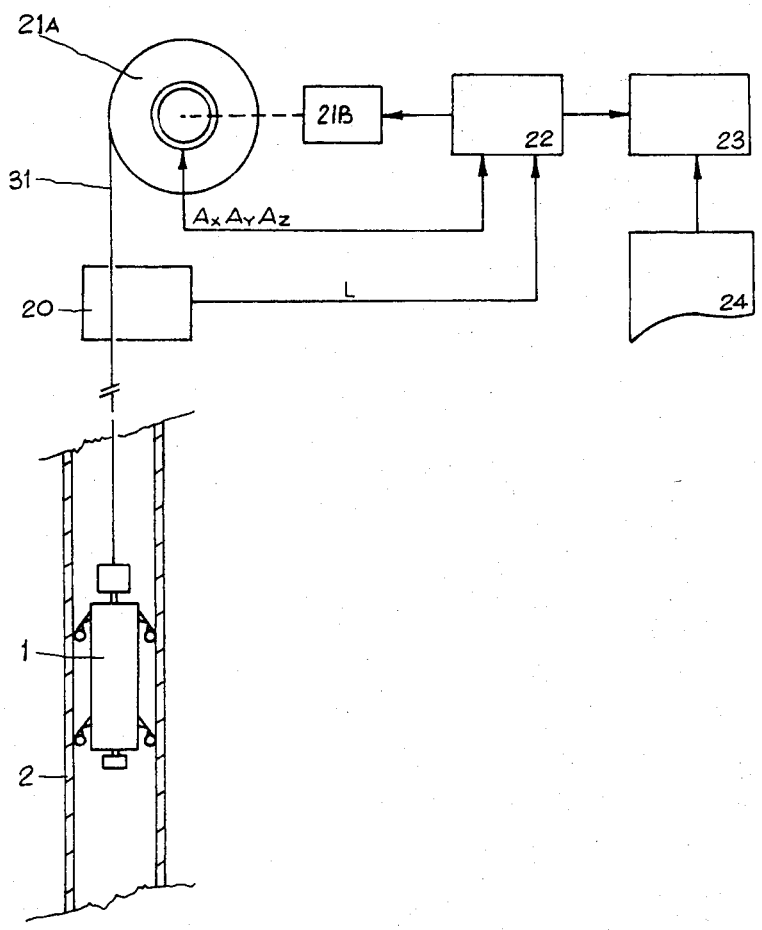
FIG. 3 shows schematically a borehole plotting system.

FIG. 3 shows schematically a borehole measuring system utilizing an embodiment of the invention. The system comprises a probe 1, various embodiments of which will be hereinafter described, in the liner 2 of a borehole. The probe produces signals from three gravity sensors carried by the probe, the sensors producing signals from one or more of which angular coordinates may be computed.

The system further includes a load and communication cable 31, borehole length measuring means 20, a cable winch 21A with controlled drive 21B and computing means comprising angular coordinate and cable length logger 22, and a computer 23 programmed by a program 24 to generate for example, either singly or in combination, the azimuth angle, slant angle, and distance coordinates, of the borehole at positions or to plot the borehole axis.

Figure 4:
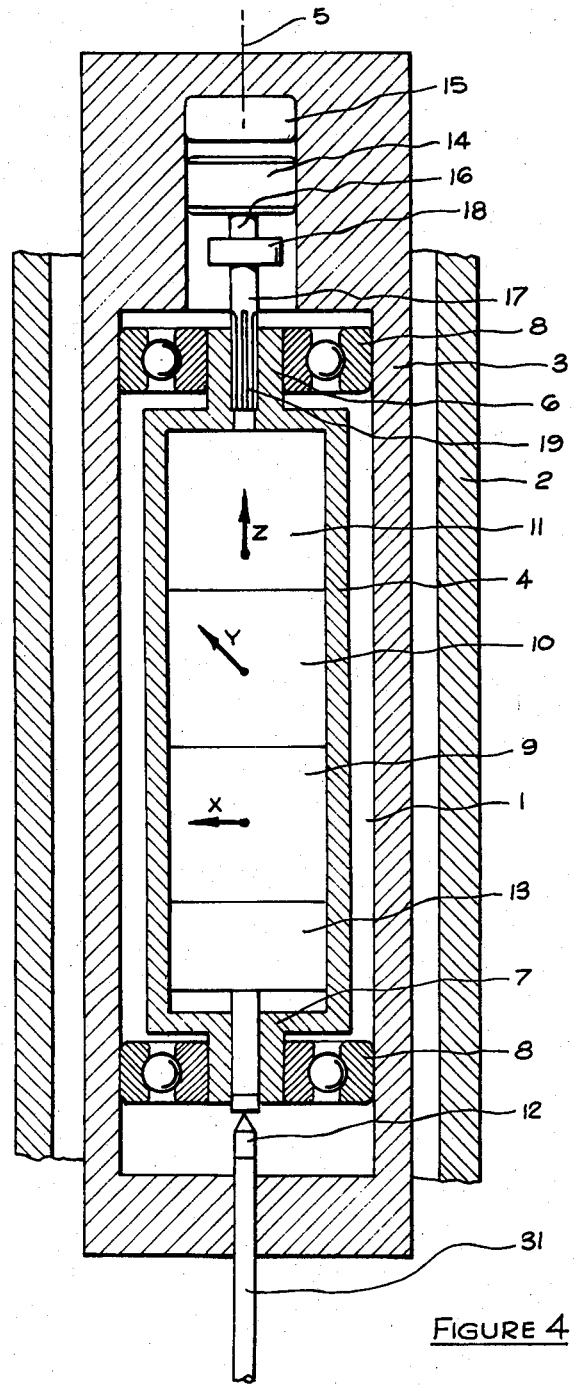
FIG. 4 is a longitudinal section showing in more detail a first embodiment of the probe appearing in FIG. 3.

With reference to FIG. 4 there is shown in more detail a first embodiment of probe 1 shown in FIG. 3 and according to the invention which is surveying inside a borehole defined by wall or liner 2.

The probe comprises a generally cylindrical case 3 having a rotor 4 mounted internal of case 3 for rotation about probe axis 5 by means of lower stub axle 6 and upper stub axle 7 each supported by a low friction bearing 8.

A gravity sensor which in the present embodiment is three accelerometers, 9, 10, 11 is fixedly mounted to rotor 4 which may be hollow and have sensors 9, 10 and 11 mounted therein. Each accelerometer measures the component of the gravity vector in a sensor direction. In the present embodiment the sensor direction of sensor 9 ("X sensor") is perpendicular to probe axis 5, the sensor direction of sensor 10 ("Y sensor") is perpendicular to that of sensor 9 and to axis 5, while that of sensor 11 ("Z sensor") is coincident with the probe axis, that is at right angles to sensor directions of sensor 9 and 10.

Rotor 4 may carry interface circuit 13 described hereinafter which receives electric signals from accelerometers 8, 9 and 10 and encodes signal data for transmission from the probe to a receiver outside the borehole, as well as receiving data transmitted to the probe for example to control electric motor 14.

Electric motor 14 is mounted to probe case 3 and has speed reduction gears (not shown in FIG. 4) on one of its drive shafts. When motor 14 is energised by batteries indicated at 15, one motor shaft 16 rotates in the present example at approximately 6,000 RPM while the speed reduced shaft 17 rotates at approximately 1 revolution per ten seconds. Shaft 16 is connected to one side of an electric clutch 18 fixedly mounted thereto while shaft 17 is engaged to rotatably drive rotor 4 by means for example of key formations 19 on shaft 17 fixed to the otherside of clutch 18 sleeved by, and interengaging with, corresponding formations on lower stub axle 6.

Motor 14 and clutch 18 are such that when not energised, the rotor 4 is rotated due to its own rotational inertia, acting as a flywheel.

Rotor 4 therefore constitutes a mass such that its rotation is, due to inertia, substantially independent from rotation of probe case 3 about axis 5.

Various means may be used to transmit signals from the sensors in rotor 4 or from the interface circuit if it is located in rotor 4, to the signal cable 31. In the present example upper stub axle 7 is hollow so that cables may be passed therethrough to low friction slip-ring 12 whereby signals to or from sensors 9, 10 or 11 may be transmitted via interface 13, slip-ring 12 and cable 31 to computing means. In other embodiments optoelectrical coupling is used.

Thus in the first embodiment, probe 1 constitutes a body and axis 5 constitutes a reference axis of the body. Accelerometers 9, 10 and 11 together constitute first gravity sensor means and could be replaced by the single accelerometer 9.

Means for measuring the change in reference angle comprise accelerometers 9, 10 and 11 and their mounting arrangements permitting their undriven rotation which together with rotor 4 constitute a mass.

Motor 14 and clutch 18 constitutes drive means for driving the mass to a predetermined velocity and then allowing it to rotate undriven.

Circuits to be described later provide means for comparing the gravity sensor signal or signals during differing periods so that change in reference angle may be determined from the signals. Change in inclination of the gravity sensor direction may also be determined for example by comparing the amplitude of the signal from accelerometer 9 of from accelerometer 11 with the amplitude of the signal when the body has known inclinations.

A second embodiment of a probe 1 for use according to the invention will now be described with reference to FIGS. 5 and 6. Probe 1 is surveying inside a borehole having a wall or liner 2. Probe 1 has a lower case 3 which is connected to an upper case 30 by means shown in more detail in FIG. 6. Upper case 30 connects directly to cable 31 and, via a ball-bearing 32, with lower case 3 which is internally of similar construction to the first embodiment as shown in FIG. 4. Lower case 3 has means to restrain it from rotation consisting of external tracking means to engage the borehole wall or liner 2 comprising levers 33 with loading springs 34 and latching and releasing means to be described in more detail below. The ball bearing 32 allows free rotation between the lower case 3 and upper case 30. Thus the rotation of the cable around the borehole axis which is apt to occur is not transmitted to the lower case 3. Furthermore, rotation of lower case 3 is restrained if not entirely prevented by the tracking means during advance of the probe and is restrained during intervals when the probe is stationary for example when motor 14 is used to bring the rotor to a predetermined angular velocity.

The said tracking means comprise a plurality of swing mounted levers 33 carrying rollers 41 urged into pressure contact with the liner 2 by loading coil springs 34. In the illustrated embodiment the springs 34 do not bear directly on their associated levers 33, but rather on latch bolts 35. When the probe is being lowered into the bore hole the latch bolts 35 are held in a retracted position by means of spring loaded balls 36 engaged in grooves 37 in the latch bolts. When the probe hits the bottom of the borehole, plunger 38 is pushed upwards to overcome the restraint of the balls 36 and drive the latchbolts outwards so permitting the springs 34 to become effective. For preference the lower levers 33 are mechanically connected by means (not shown) to the upper levers 33 so that all levers act in concert.

In this embodiment the electrical signals from the sensors internal of lower case 3 via the electronics interface 13 are transmitted through opto-electronic devices 39 and 40 to the cable 31 which serves both to take the weight of the probe and to act as an electrical communication medium simultaneously. These electrical signals are taken off the cable 31 by, for example, a slip ring associated with the winch 21 (FIG. 3) and are fed to logger 22 and to the computer 23. Borehole length data L from the length measuring means 20, which may comprise for example, a free rotating jockey wheel frictionally driven by the cable 31 and associated revolution counter is also fed to the logger 22.

The cable 31 may be connected to the probe 1 by a conventional coupling. The ball bearing 32 is held in place by a circlip 27 and a nut 26 as shown in FIG. 6. The levers 33 with coil springs 34 are mounted on pivot pins 28.

According to one method of using the embodiments of probe 1 described above, rotor 4 is spun by motor 14 to a predetermined velocity while the probe is stationary at each of a plurality of borehole locations O, $O_1$, . . . $O_i$ (FIG. 2).

Rotor 4 is then allowed to spin undriven while the probe advances from each such location to the next. The probes advances $OO_1$, $O_1 O_2$, . . . $O_{i-1} O_i$ . . . take place during identical time intervals. In this method it is not essential that the velocity of rotor 4 remains constant while undriven but merely that it is reproducable during the specified time interval and that successive measurements are taken during identical time invervals.

Since the parameters of the spinning mechanical system remain constant during successive specified time intervals, the drift in rotation angle $\alpha_R$ of the probes rotor carrying the gravity sensors will remain constant during successive time intervals if the azimuth angle remains constant and can be determined and hence change in $\alpha_R$ due to change in azimuth angle can be determined.

Figure 7A:
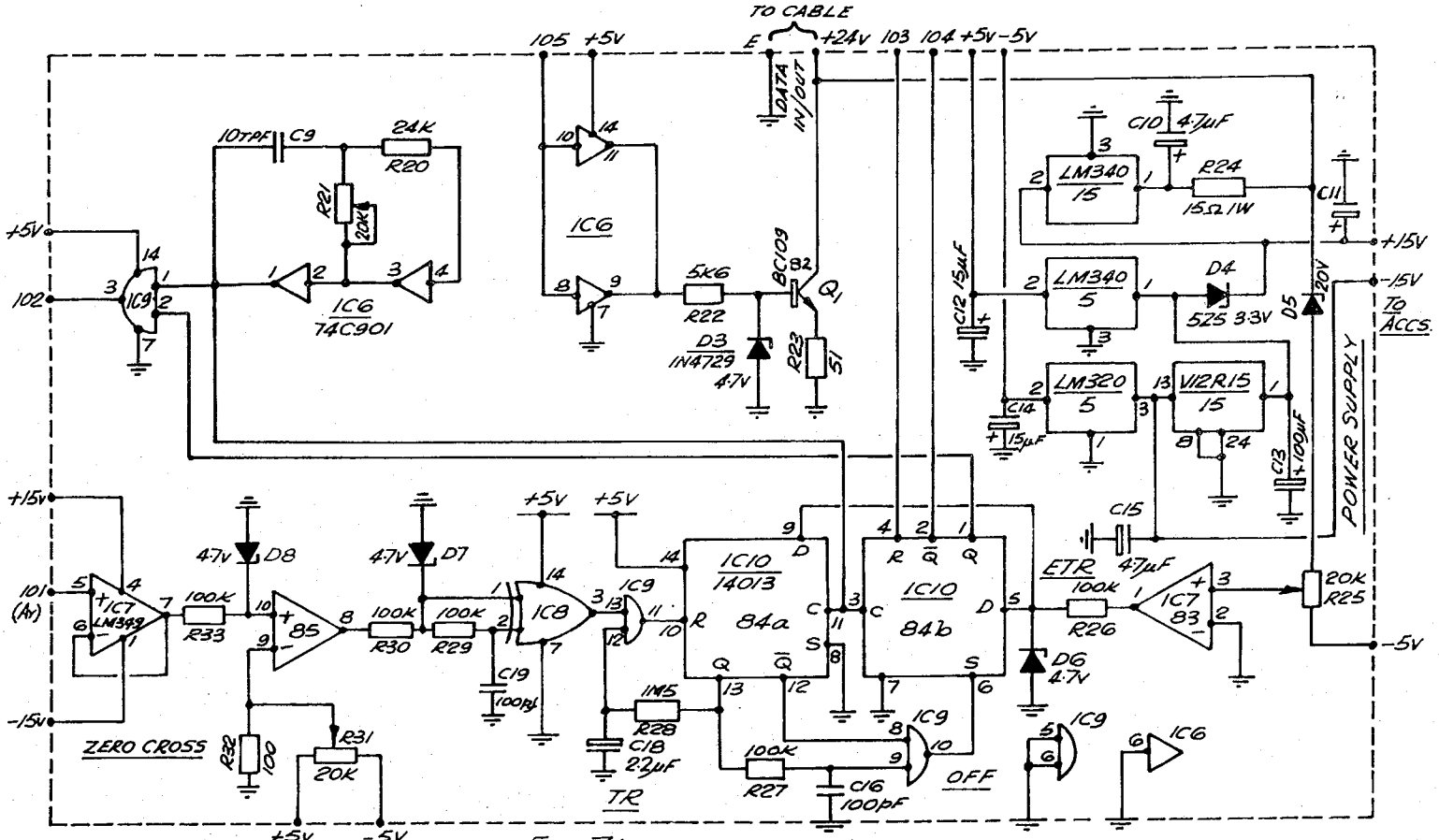
FIGS. 7*a* and 7*b* is an example of interface circuitry for use in a probe such as shown in FIGS. 4 and 5.
Figure 7B:
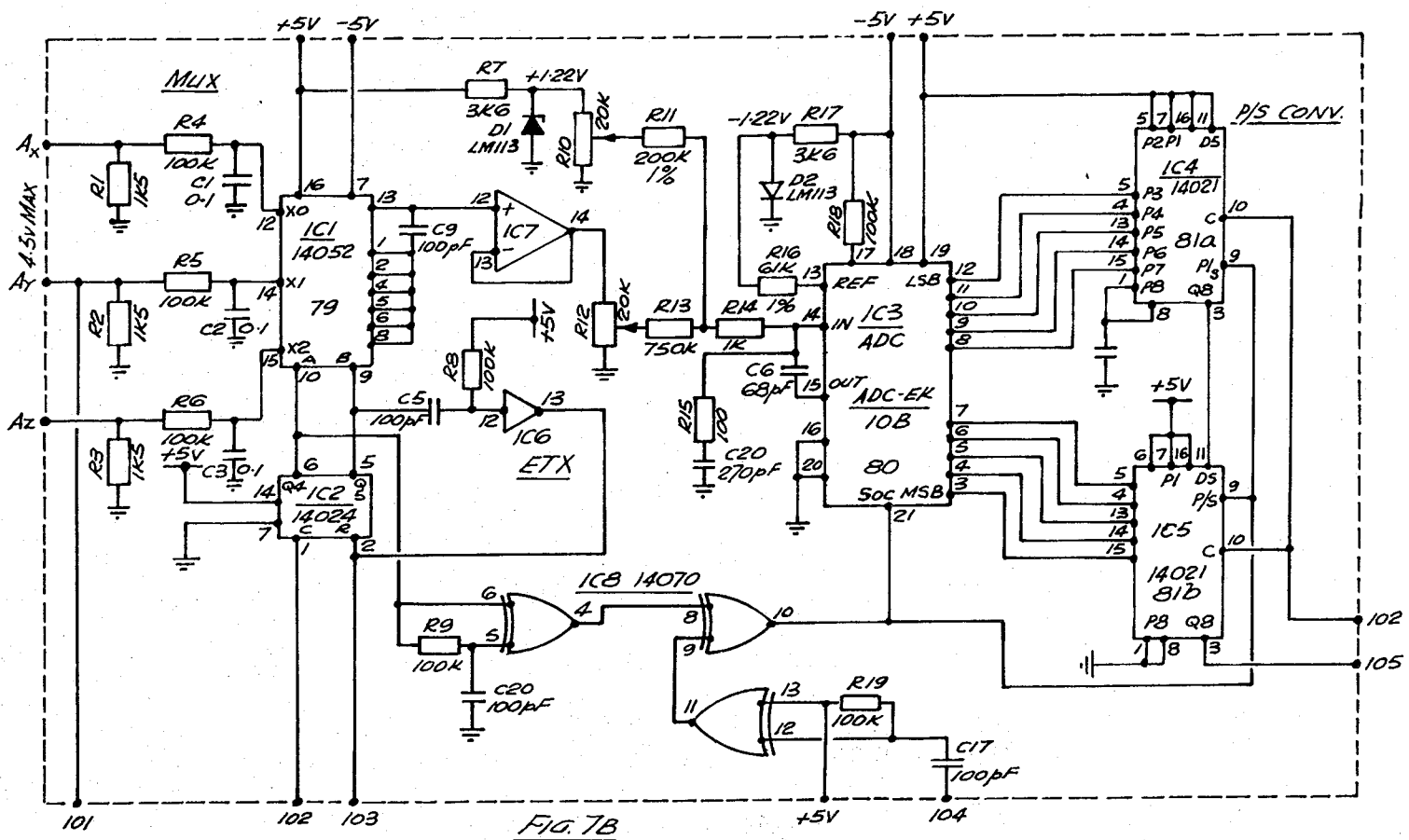

FIG. 7 shows by way of example an embodiment of the interface circuitry 13 for probe embodiment shown in FIGS. 3 and 4 use in the above method. The signals Ax, Ay, Az from accelerometers 9, 10 and 11 are delivered to the A/D converter 80 through the multiplexer 79. The 10 bits parallel outputs of the converter 80 are carried out to the shift register IC4 and IC5 forming the parallel-to-serial converter 81. The serial output Q8 from IC5 via the buffer IC6 feeds the current switch 82, changing the current into the cable 31, whereby data from the probe are carried to data logger 22.

The data from gravity sensors are transmitted after the end of an undriven rotation time interval which is marked by sending to the probe a pulse initiating by the data logger, e.g. with rising voltage, into cable 31. This short pulse "END OF TIME RELAY" (E.T.R.) from the cable is delivered to receiver 83 and switches on time relay 84A with the time circuit C18 R28. After the time delay set up through the circuit C18 and R28 the time relay 84A is switched off by the zero crossing detector 85 and gate IC9. The zero detector defines the origin of the angle of rotation of the rotor from the voltage produced when the Y accelerometer in this example is crossing zero.

Relay 84A defined a time interval at the end of which the linear movement of the probe is interrupted. After the switching off of the time relay 84A, control part 84B of the relay through IC8 forms the signal SOC which delivers data from the A/D converter 80 to the current switch 82 and cable as described above.

Figure 5:
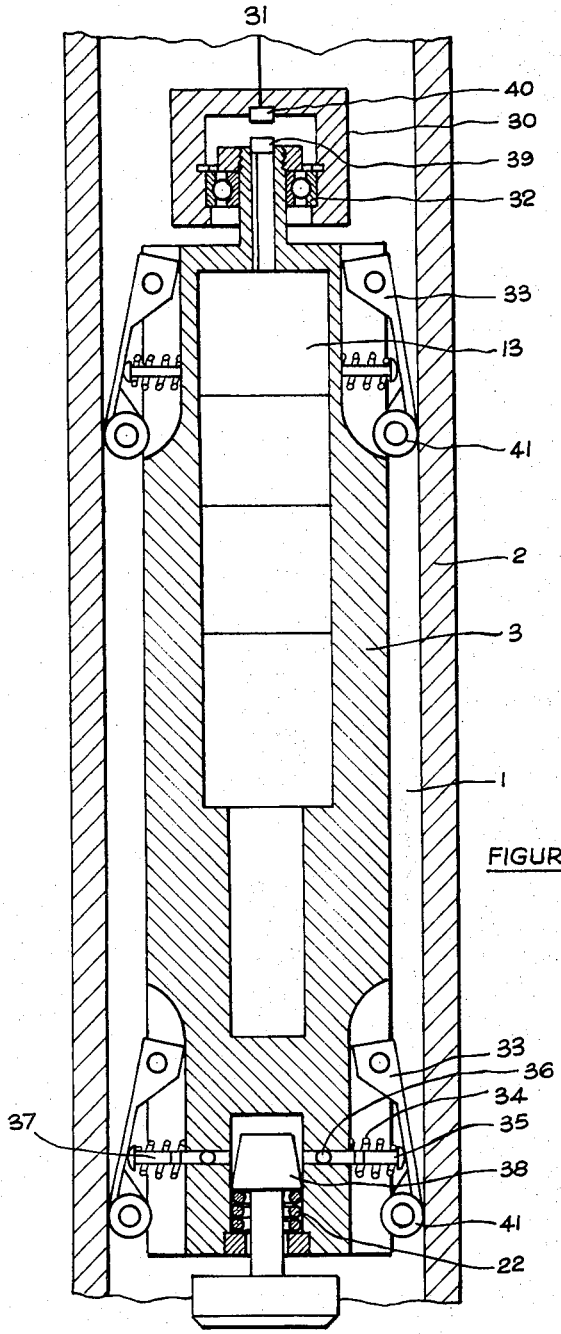
FIG. 5 is a longitudinal section showing a second embodiment of the probe appearing in FIG. 3.
Figure 8A:
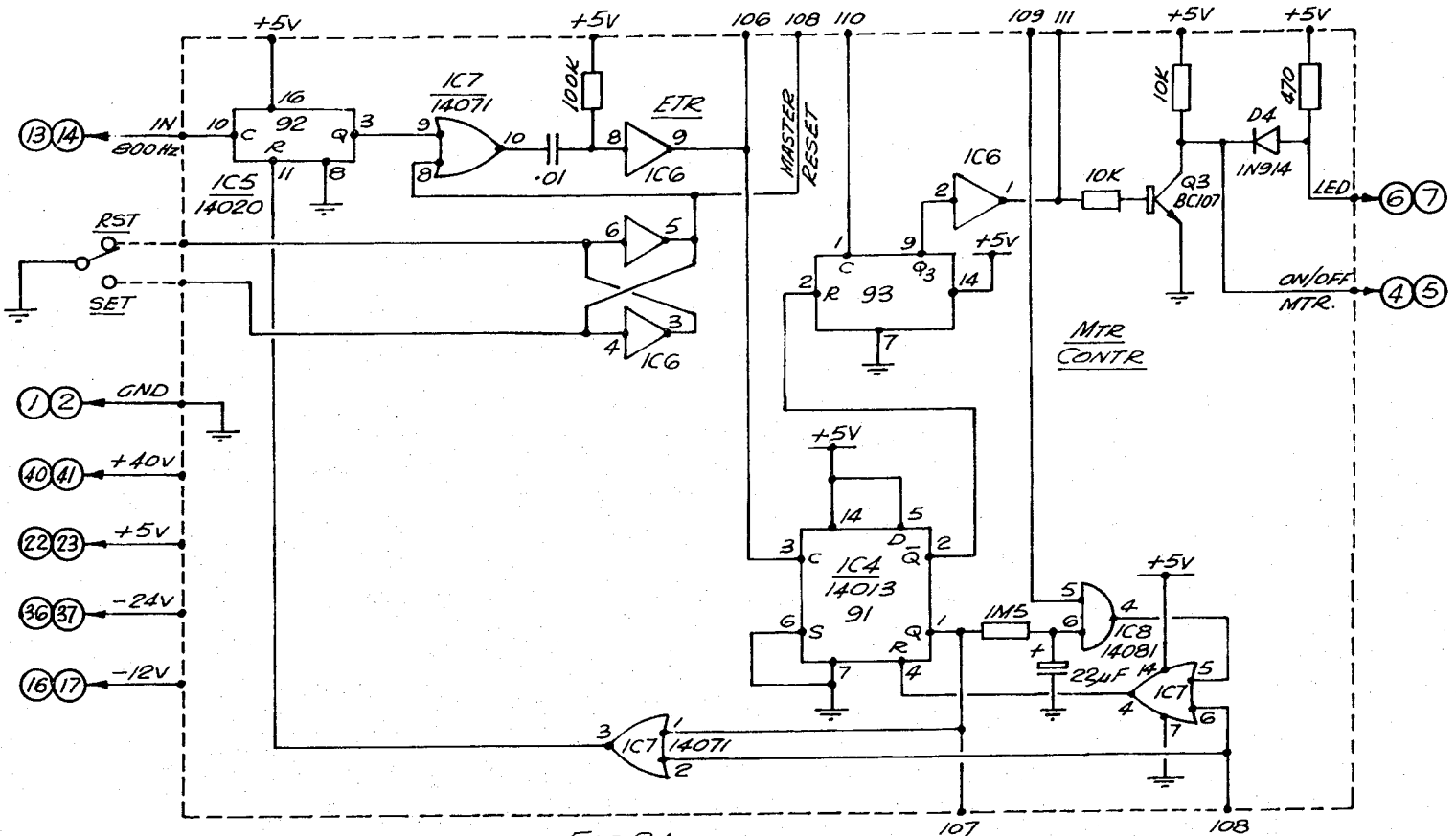
FIGS. 8*a* and 8*b* is an example of receiving/transmitting circuitry cooperating with the circuit shown in FIG. 7.
Figure 8B:
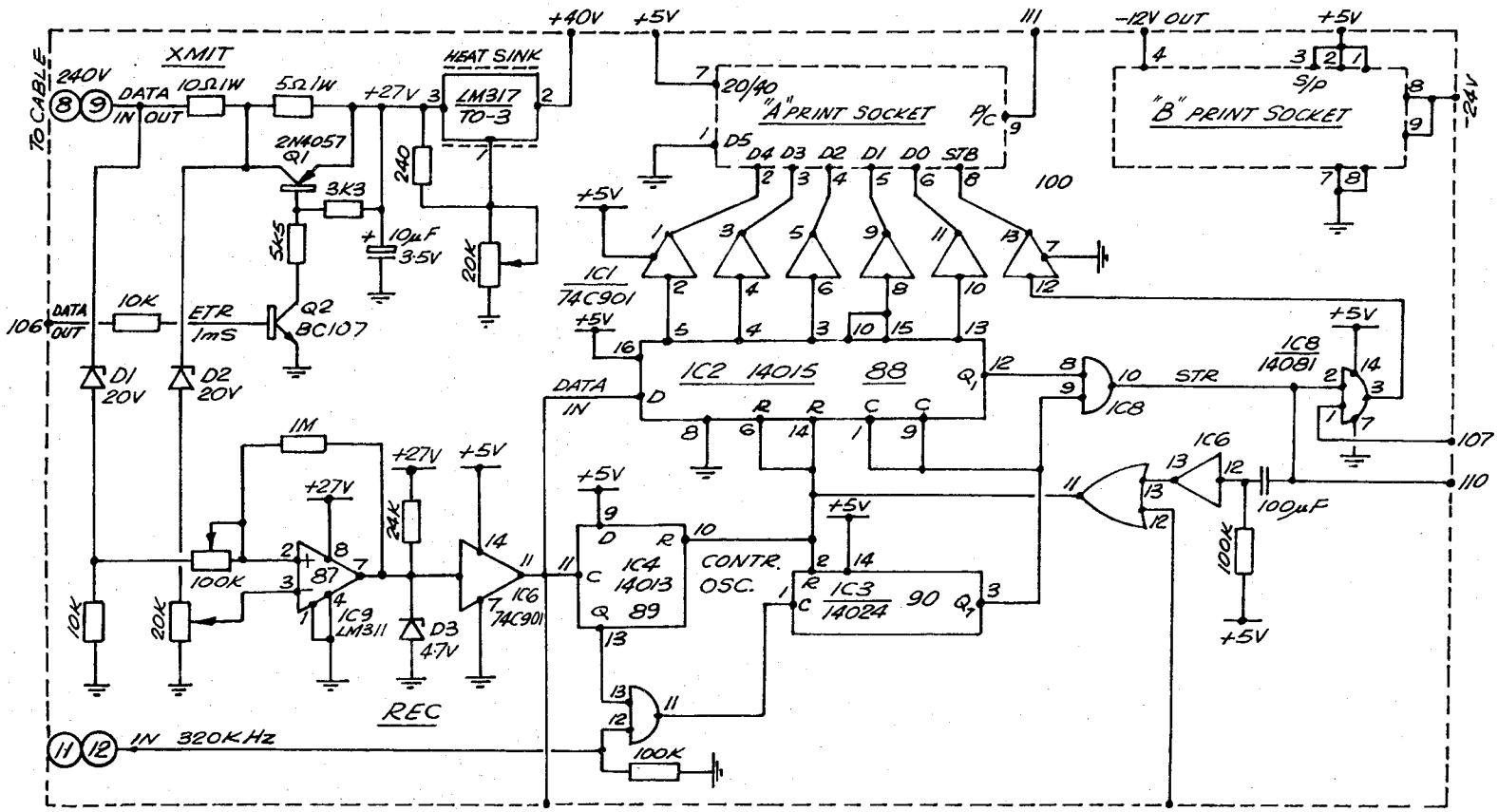

FIG. 8 shows in more details and embodiment of the receiver/transmitter part of logger 22 for use with the circuit of FIG. 7 and the probes of FIGS. 4 and 5. The data from the probes rotor is delivered from the current switch 82 via coupling 12 and cables 31 to the receiver 87. The serial data in the start-stop mode are derived from the receiver and fed to serial-to-parallel converter 88 and via buffer ICI, the parallel data feeding a recorder e.g. a printer or random access memory. The serial-to-parallel converter 88 is controlled by start detector circuit 89 and clocked from controlled oscillator 90. Data from the probe which marks the switching off of the probes time relay 84A, set on the precise time relay of the logger 92, is initiallised from a start pulse of the start-stop word received by the receiver 87. This relay delivers the precise time delay from counter 92 which output Q14 via pulse shaper IC6 forms the ETR signal and controls the transmitter circuit 86 formed by transistors Q1 and Q2. The transistor Q1 switches on and the rise in the cable voltage sets up the probe receiver 83 thus releasing to A/D converter 81 and submitting data from accelerometers to the cable. The number of the words received from the probe transmitter, presumably 8 words, are counted by the counter 93. After their reception the probes motor gets a command "ON" and winch 1 is stopped. During the time relay 91/92 is switched on the winch operates and the probe 1 moves along the borehole. A printer is connected at interface 100 to print out voltages of each sensor for feeding to a computer programmed to calculate probe co-ordinates.

The free rotation of the gravity sensors about the linear borehole trajectory separates rotation from sliding movements of the probe in the borehole as long as the total spinning rotation angle $\alpha_R$ is steady for a reference time. The azimuth and slant angles can easily be calculated from gravity sensors data for example slant angle which is invariant to the probe rotation may be defined at $O_i$ location as follows:

$$\phi_i = ASIN\left\{\sqrt{(A_x2 + A_y2)_{i/g}}\right\} = ATAN\left\{\sqrt{(A_x2 + A_y2)/A_{zi}}\right\} \quad (1)$$

$$\text{where } g = \sqrt{A_x^2 + A_y^2 + A_z^2}$$

is a gravity constant; $A_z = g * \cos\phi$ is a first component presumably voltage or current from accelerometer directed along longitudinal axis of a probe.

$A_x$ and $A_y$ are the first components from accelerometer settled at 90° to the probe's longitudinal axis as well as to each other.

The increment of the bearing angle can be calculated with the following formula:

$$\Delta\beta_i = \{ATAN(A_y/A_x)_i - \alpha_{Ri}\} \quad (2)$$

where $\alpha_{Ri} = \int_o To \alpha_R(t)$ - is a constant for reference time To.

The azimuth can be defined according to the FIG. 1 as a vector sum as follows:

$$\vec{\alpha}_i = \vec{\alpha}_o + \sum_{k=1}^{i} \vec{X}_k = \vec{\alpha}_o + \sum_{k=1}^{i} (\vec{X}_{k-1} + \Delta\vec{\beta}_k) \quad (3)$$

Where $X_k$ is a direction of the X axis into locations $O_1, O_2\ O_i$ defined as a tangent to the borehole curve; $\alpha_o$ is an initial probe azimuth orientation at the origin O.

The angle of rotation on the end of a time interval can be found by various methods for example by measurement in static probe position for the O and $O_n$ locations and using the linear interpolation for locations $O_i$.

A third embodiment of the invention will now be described with reference to FIG. 9.

Figure 6:
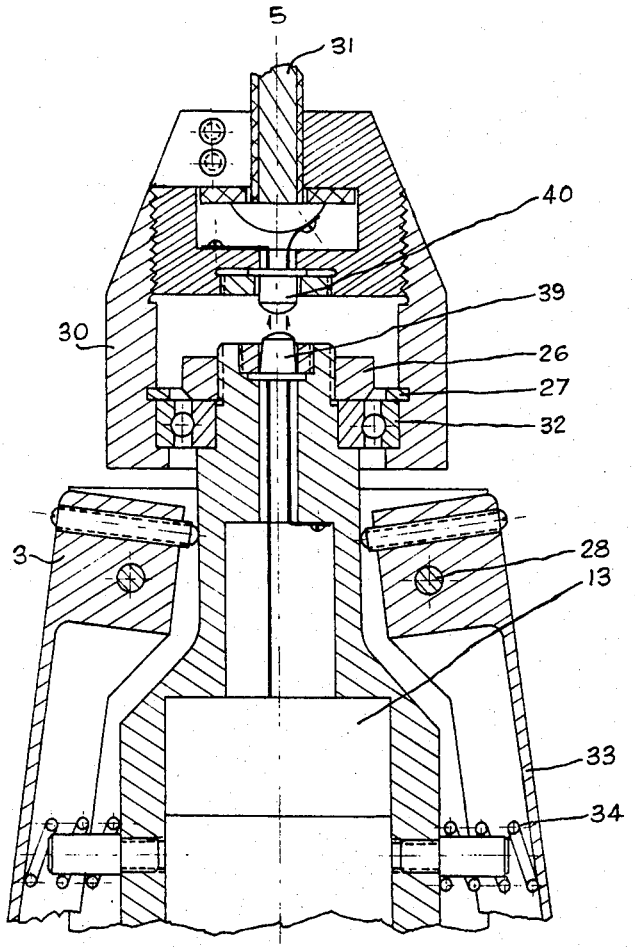
FIG. 6 shows a longitudinal section in more detail of a part of the probe shown in FIG. 5.
Figure 9:
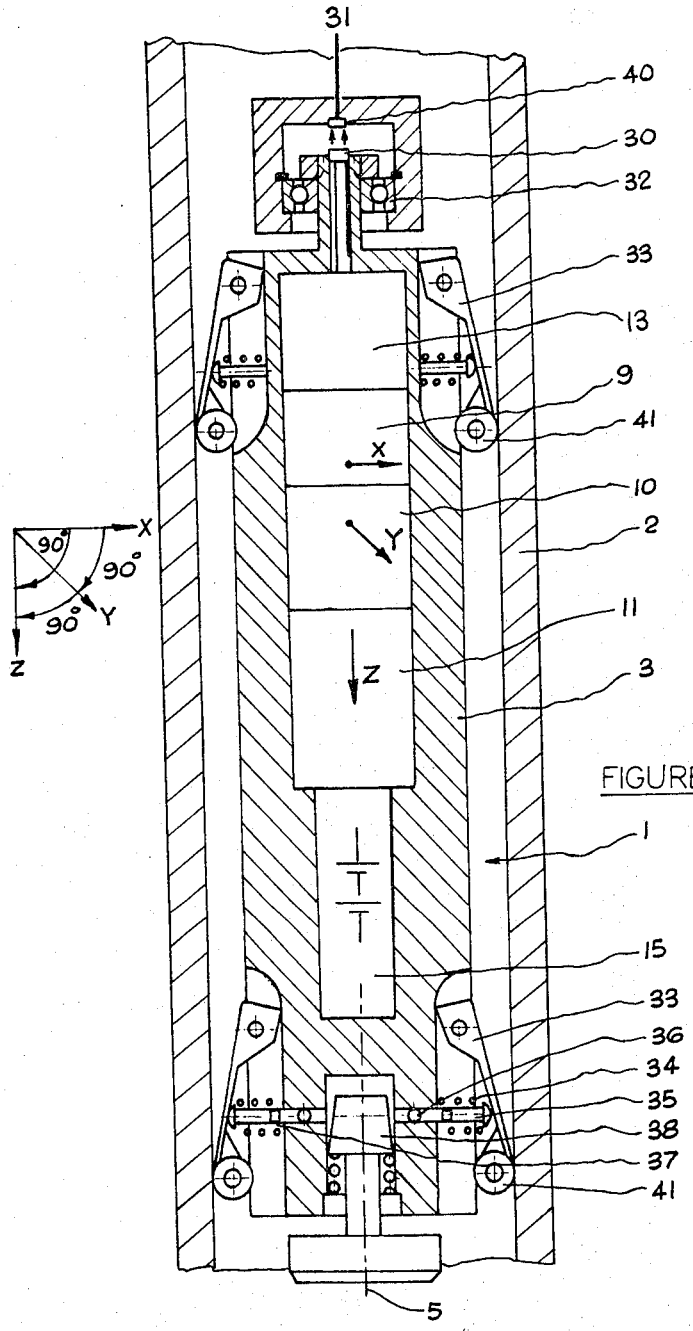
FIG. 9 is a third embodiment of a probe according to the invention.

In this example probe 1 is similar to that described in FIGS. 5 and 6 having an upper case 30, a lower case 3 and external tracking means 33 and the numbers used to identify parts in FIGS. 5 and 6 identify corresponding parts in FIG. 9.

This embodiment differs from the second embodiment only in its internal construction. Instead of a rotor, motor and clutch this embodiment merely has accelerometers 9, 10 and 11 mounted fixedly to lower probe case 3, the accelerometers being set at 90° to each other and one sensing in the probes axial direction.

In this embodiment electrical signals from the sensors via an electronics interface 13 are transmitted through opto electronic devices 39 and 40 to cable 31 which serves both to take the weight of the probe and to act as an electrical communication media simultaneously.

These electrical signals are taken off the cable 31 by, for example, a slip-ring associated with the winch 21 and are fed to a logger 22 and thence to computer 23. Borehole length data L from the length measuring means 20, which may comprise for example, a free rotating jockey wheel frictionally driven by the cable 31 and associated revolution counter is also fed to the logger 22.

Figure 10:
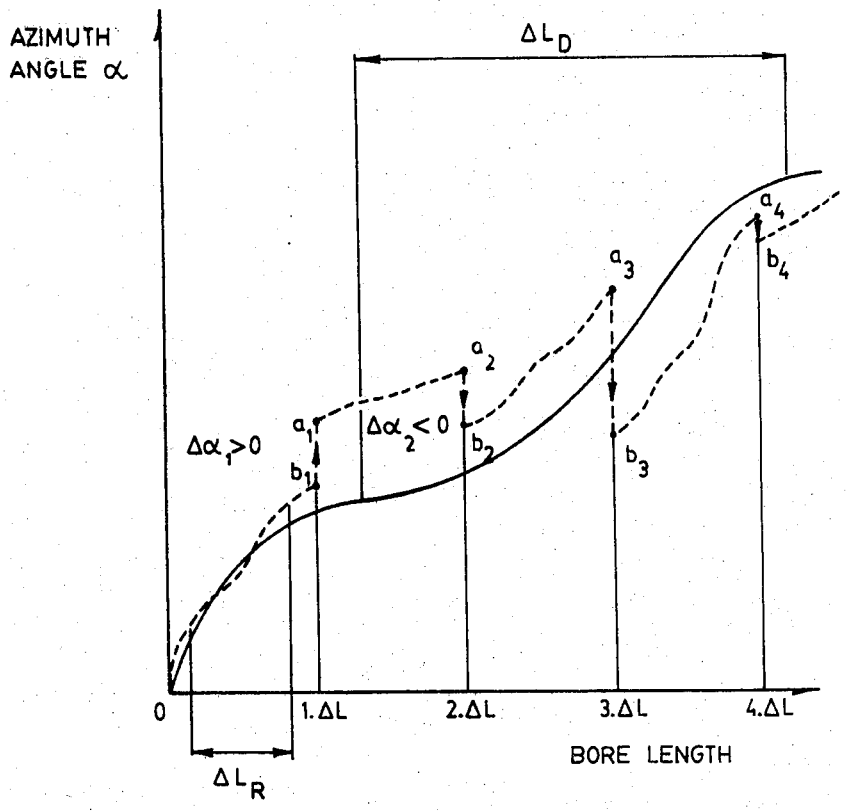
FIG. 10 is an example of an azimuth curve having abrupt discontinuities.
Figure 11:
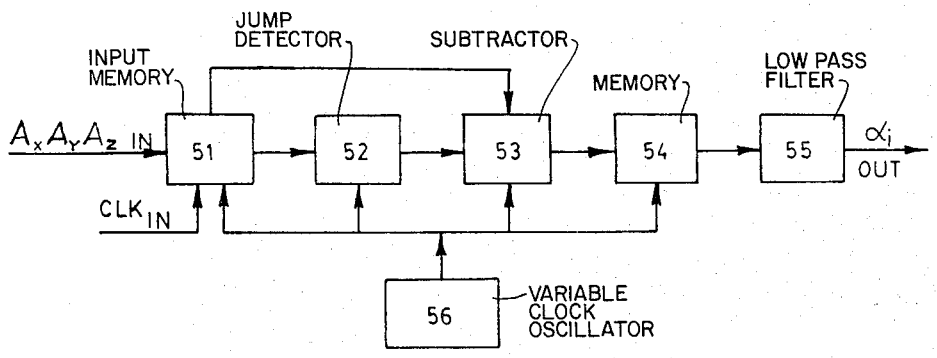
FIG. 11 is a block diagram of azimuth angle computing means for use with the probe of FIG. 9.

The tracking means prevent substantial or fast rotation of the probe lower case 3 about its own axis. Nevertheless, at the threaded joints between the individual lengths of borehole casings abrupt rotation of the lower case 3 of the probe is possible. This case is illustrated in FIG. 10 at the points 1ΔL, 2ΔL etc., where ΔL is the individual pipe length, and the intervals $a_1$, $b_1$, $a_2$, $b_2$, corresponding to the azimuth angle errors $\Delta\alpha_1$, $\Delta\alpha_2$ indicate the extent of such abrupt rotation. Using the feature of the borehole curve discontinuity, these azimuth jumps may be eliminated by software 24 programming the computer 23 (see FIG. 3). Thereupon the aximuth angle measuring data may be fitted by the software computer using an appropriate known mathematical method to fit functions, for example, the method of least squares and the correlation theory for the additional elimination of azimuth curve continuous with a frequency more than the frequency of the maximum and minimum changes of the azimuth curve, that is to say when $\Delta L_D > \Delta L_R$ with reference to FIG. 10. The Block diagram of the part computing means for a definition of the azimuth angle is shown in FIG. 11. The data $A_x$, $A_y$, $A_z$ as measured by the accelerometers are fed into the input memory 51 with the "CLK IN" frequency of the measurement. This frequency corresponds to the number of points on the borehole length at which measurements are taken. The output of the memory is applied to a jump detector or comparator 52 which compares the input data and defines the discontinuities of the azimuth angle measurement due to the additional rotation of the probe part 3.

Both the jump detector output and the output of memory 51 are applied to a subtractor 53 which eliminates the discontinuities of the azimuth angle measurement. The modified azimuth angle data through an intermediate memory 54 are applied to the input of a low pass filter 55 which masks the high frequency components. In order to derive the azimuth angle curve the cut-off frequency of the low pass filter 55 corresponds the scale of the borehole length intervals where the measurements are taken up, and is controlled by the variable clock oscillator 56 via the memory 54.

Figure 12:
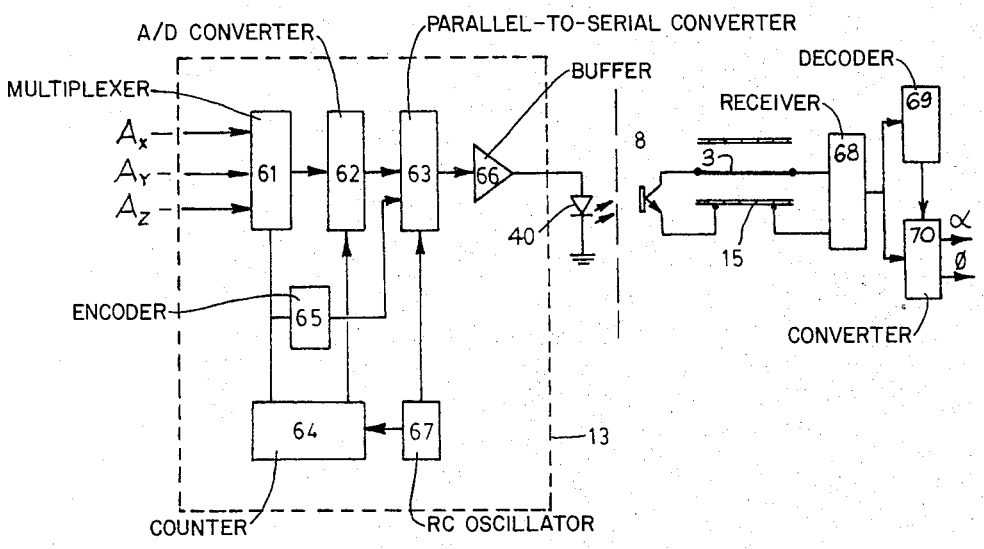
FIG. 12 is a block diagram of means for the transmission of data from the probe of FIG. 9 to computor means.

With reference to FIG. 12 the transmitted light pulses are received by a photo-transistor 40 within probe part 30. The transistor 40 switches on and off, and by way of the insulated cable 31, it feeds receiver 68. The receiver 68 provides the data pulse train and clock pulses which are disturbed to the decoder of the code mark separating the $\alpha$ and $\phi$ channels. The outputs from receiver 68 and the output of the decoder 69 are delivered to the serial-to-parallel converter 70 where the final separation of the $\alpha$ and $\phi$ data channels is realized.

Figure 13:
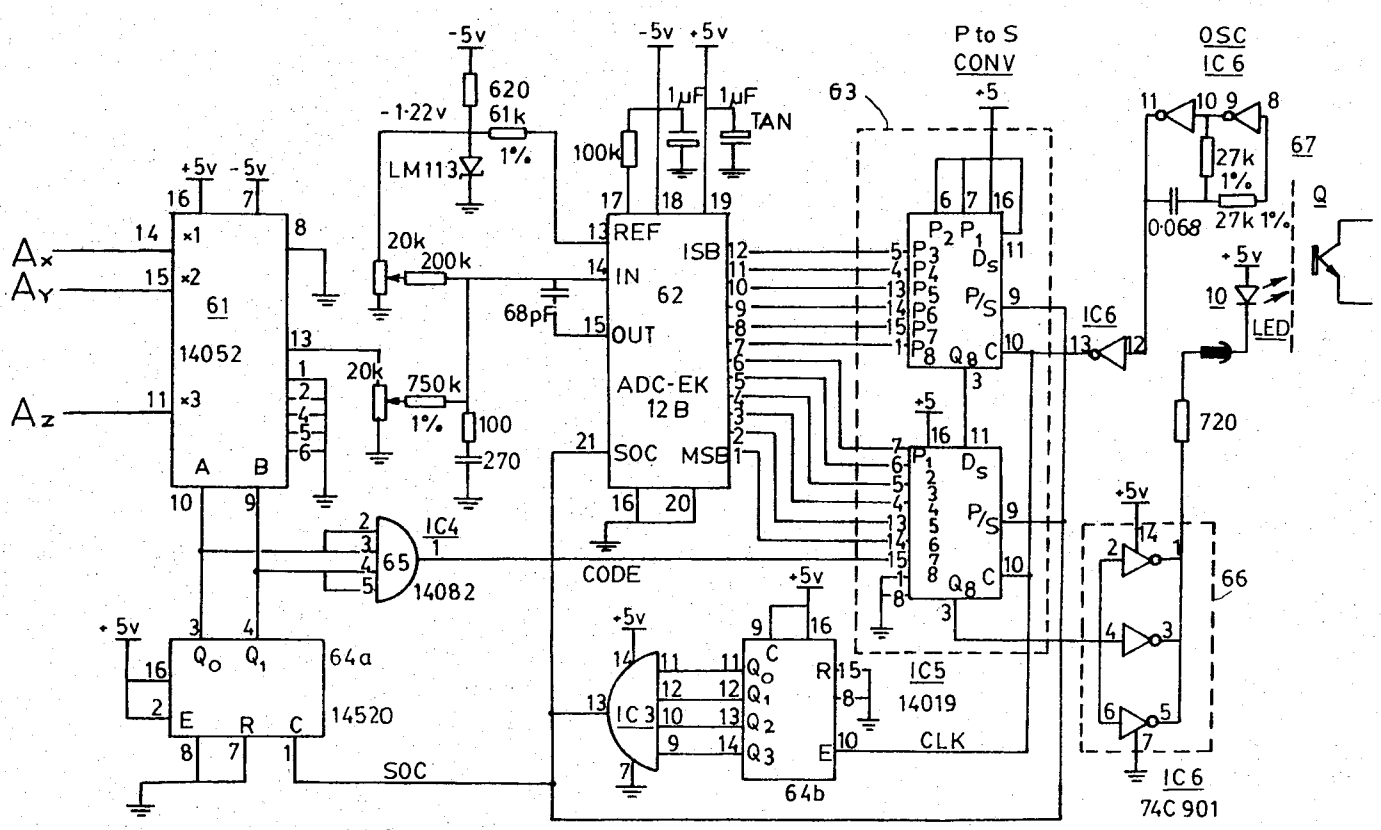
FIG. 13 shows an embodiment of interface circuitry for use with the probe of FIG. 9.

FIG. 13 shows in more detail an embodiment of the interface circuitry 13 for use with probes according to the third embodiment. The output of the integrated circuit multiplexer 61 is delivered to the A/D converter 62. The 12 bit parallel outputs of the A/D converter 62 are carried out to the parallel and serial shift registers IC4 and IC5 forming the parallel-to-serial converter 63. The serial output Q8 from IC5 via the Buffer 66 feeds the infra-red LED 40. The RC oscillator 67 provides clock pulses to the serial/parallel shift registers IC4, IC5 and to the counter 64*b* which via gate IC3 provides the START OF CONVERSION pulse to the ADC. These SOC pulses are the clock pulses for the multiplexer's counter 64*a*, which controls the multiplexer 61. Also, the outputs of the counter 64*a* are the inputs 2, 3 and 4, 5 of the encoder 65 which forms the "1" multiplexer's channel 3 (or $A_z$ co-ordinate channel). The output "O" of the encoder 65 is for 1 and 2 channels or $A_x$ and $A_y$ co-ordinate channels. The encoder output is applied to the parallel input of IC5 and it marks the co-ordinate. The time distribution for the receiver is formed by the 16 bit start-stop serial word where the start bits is written "0" from input $P_7$ of IC5 and stop bits are set up by the "1" from $P_1$, $P_2$ of IC4. Thus the 16 bit serial word consists of 12 bits of the ADC, one start bit, two stop bits and one code bit.

Thus the third embodiment of the probe may be considered to be a body having a reference axis and first gravity sensor means 9 which in this embodiment is fixedly mounted to the probe.

The rotation determining means consist in a tracking means for substantially eliminating random of the probe rotation except for abrupt discontinuities e.g. as occurs at borehole liner junctions and computer means for eliminating the effect of such abrupt discontinuities from the first sensor signal.

Means for determining change in inclination of the first sensor direction in the third embodiment consist for example of a second gravity sensor 11 mounted axially in the probe so as to be invariant with rotation.

Alternatively a second gravity sensor 10 at 90° to the first may be used for this purpose or three sensors at 90° to each other may be used.

It will be understood that a probe according to the invention need not be equipped with 3 gravity sensors and that one will suffice although three as described provide greater sensitivity when slant angle is highly variable. Similarly, use of a computing apparatus to analyse and calculate data output from gravity sensors and use of distance measuring means, while desirable, is not essential.

Apparatus according to the invention may be used with means other than those discussed for determining slant angle and distance.

It will be appreciated that means for transmitting data from sensors in a probe according to the invention to a user or a data processor outside the borehole may include wireless transmitting and receiving means, and that when electronic computer means are used, the circuits thereof may be incorporated to a greater or lesser degree within the probe so as to process or preprocess data prior to transmission from the probe. Various circuits for comparing gravity sensor signal data with a reference time scale may be used and automatic control of the drive motor is not essential.

When rotation restraining means are used, the borehole liner may be provided with formations interengageable with tracking means of the probe or as part of such means.

When tracking means are fitted and are retractable, engagement with the borehole wall may be brought about in a number of ways additional to those described above, for example, by including electrical impulses applied to an electromagnetic latch release and the probe may be provided with means for retraction of the probe tracking means.

I claim:

1. Means for providing data for determining a change from one direction to another of a reference axis fixedly associated with a body, when at least one of said directions is non horizontal, comprising:

first gravity sensor means defining a first sensor direction which is at a constant sensor angle with respect to said reference axis, for producing a first signal or signals responsive to the component of the earth's gravity vector in said first sensor direction, a mass fixedly associated with said body and mounted for undriven rotation about said reference axis, said first sensor means being, or being fixedly associated, with said mass; the inertia of said mass being such that said sensor direction at any instant is substantially independent of rotation of said body about said reference axis, drive means whereby said mass may be driven to a predetermined angular velocity about said reference axis and then allowed to rotate undriven, and means for comparing selected parameters of said first signal or signals as occurring during one time period with said selected parameters as occurring during another time period.

2. Means according to claim 1 wherein said first sensor means is a linear accelerometer, and said sensor direction is the direction in which said accelerometer measures the component of the earth's gravity vector.

3. Means according to claim 1 wherein said sensor direction is at ninety degrees to said reference axis.

4. Means according to claim 1 wherein said first signal is a voltage or current signal.

5. Means according to claim 1 wherein said gravity sensor means is fixedly associated with flywheel means whereby the rotational inertia of said first gravity sensor means is increased.

6. Means according to claim 1 wherein said drive means comprise electric motor means fixedly associated with said body.

7. Means according to claim 1 wherein the rotational inertia of said body about said reference axis is large compared with that of said mass.

8. Means according to claim 1 wherein said body is a probe for surveying in boreholes as herein defined further comprising tracking means for preventing rotation of said probe at least during periods when said mass is being driven to said predetermined velocity.

9. Means according to claim 1 further comprising clutch means whereby said drive means may be engaged with or disengaged from said mass.

10. Means according to claim 1 when said first gravity sensor means comprises two linear accelerometers each measuring a component of the gravity vector in a direction at 90° to the other and to said reference axis.

11. Means according to claim 1 when said first gravity sensor means comprises three linear accelerometers each measuring the component of the gravity vector in a direction at 90° to the other two and one of which measures said component in the direction of said reference axis.

12. A method for providing data for determining a change from one direction to another of a reference axis fixedly associated with a body when at least one of said directions is non-horizontal, comprising the steps of:

A. Fixedly associating with said body a mass mounted for undriven rotation about said reference axis, said mass comprising in fixed association therewith first sensor means defining a first sensor direction which is at a predetermined sensor angle with respect to said reference axis for producing a first signal or signals responsive to the component of the earths gravity vector in said first sensor direction, the inertia of said mass being such that said sensor direction at any instant is substantially independent of rotation of said body about said reference axis.

B. driving said mass to a predetermined angular velocity about said reference axis and then allowing said mass to rotate undriven, and C. comparing selected parameters of said first signal or signals as occurring during one time period with said selected parameters as occurring during another time period.

13. A method according to claim 12 for determining a change of inclination of said reference axis comprising comparing the maximum amplitude of said signal obtained during a period when said body has a constant inclination with the maximum amplitude of said signal obtained during a period while or prior to which a change in direction of said body occurs.

14. A method according to claim 12 wherein said step of comparing comprises the steps of:

comparing a first signal obtained during each of two periods of identical duration during both of which periods said mass is rotating undriven and at the commencement of both of which periods said mass is rotating with said predetermined angular velocity, said body having a constant direction during one of said periods and said change of direction occuring during the other, and measuring the change in number of cycles of the signal including fractions thereof occuring during one period as compared with the other.

15. A method according to claim 12 wherein said step of comparing comprises the steps of:

comparing a first signal obtained during each of two periods, during both of which periods said mass is rotating undriven and at the commencement of both of which periods said mass is rotating with said predetermined angular velocity, said body having a constant direction during one of said periods and said change of direction occurring during the other, and measuring the change in duration of said periods during which a constant number of cycles of the signal occurs.

16. A method according to claim 12 wherein said step of comparing comprises the steps of:

comparing a first signal obtained during each of two periods, during both of which periods said mass is rotating undriven and at the commencement of both of which periods said mass is rotating with said predetermined angular velocity, said body having a constant direction during one of said periods and said change of direction occurring during the other, and measuring the time interval between the maximum amplitude of successive cycles of the signal during both of said periods.

17. A method according to claim 12 wherein said step of comparing comprises the steps of:

comparing a first signal during each of two periods, during both of which periods said mass is rotating undriven and at the commencement of both of which periods said mass is rotating with said predetermined angular velocity, said body having a constant direction during one of said periods and said change of direction occurring during the other, and measuring the time interval between the zero cross over point of successive cycles of said signal during both of said periods.

18. A method according to any one of claims 12 to claim 17 further comprising the step of maintaining said body stationary during periods when said mass is rotatably driven.

* * * * *